US005851368A

United States Patent [19]

Rumph

[11] Patent Number: 5,851,368

[45] Date of Patent: Dec. 22, 1998

[54] SMALL PARTS PLATING APPARATUS

[76] Inventor: Timothy P. Rumph, 6109 Vesper Ave., Van Nuys, Calif. 91411

[21] Appl. No.: 818,742

[22] Filed: Mar. 14, 1997

[51] Int. Cl.[6] ..... C25D 17/20

[52] U.S. Cl. ..... 204/213; 204/271

[58] Field of Search ..... 204/213, 214, 204/271

[56] References Cited

U.S. PATENT DOCUMENTS

| | | | |
|---|---|---|---|
| 2,766,201 | 10/1956 | Luther | 204/213 |
| 3,199,999 | 8/1965 | Greening, Jr. et al. | 204/213 X |
| 4,102,770 | 7/1978 | Moriarty | 204/195 R |
| 4,302,318 | 11/1981 | Mock | 204/229 |
| 4,317,707 | 3/1982 | Good et al. | 204/213 |
| 4,319,971 | 3/1982 | Good et al. | 204/109 |
| 4,337,135 | 6/1982 | Quinton | 204/213 |
| 4,529,486 | 7/1985 | Polan | 204/13 |
| 4,692,221 | 9/1987 | Parthasarathi | 204/13 |
| 4,822,468 | 4/1989 | Kanehiro | 204/13 |
| 5,096,550 | 3/1992 | Mayer et al. | 204/129.1 |
| 5,167,779 | 12/1992 | Henig | 204/140 |
| 5,433,834 | 7/1995 | Belz et al. | 204/213 |

*Primary Examiner*—Donald R. Valentine
*Attorney, Agent, or Firm*—Jack C. Munro

[57] ABSTRACT

A small parts plating apparatus which includes a frame on which is mounted a rotatable barrel, a motor and a battery. Operation of the motor is to cause rotation of the barrel. The motor can be operated optionally either by the battery or by being connected to the electroplating circuit of an electroplating tank.

9 Claims, 3 Drawing Sheets

5

SMALL PARTS PLATING APPARATUS

BACKGROUND OF THE INVENTION

1) Field of the Invention

The field of this invention is directed to electroplating and more particularly to the constructing of a novel small parts plating apparatus to be used in conjunction with a much larger volume electroplating tank that is normally fixedly mounted on a floor in an electroplating facility.

2) Description of the Prior art

A wide variety of items, ranging from machinery to various household articles are plated with metal coatings, usually to protect such against corrosion and also to enhance their appearance. Sometimes, in the electro-galvanizing of small objects, such as nuts and bolts, the function is purely protective. Electroplating may also be used to impart, in certain other products, to a metal surface, hardness, wear resistance and an anti-frictional, electrical, magnetic or optical property. Coating thicknesses in electroplating are commonly about one-thousandth of an inch. However, greater thicknesses are required for certain engineering applications.

Electroplating of metal coatings are achieved by being deposited on conducting surfaces. These conducting surfaces (the parts to be plated) are made the cathode. These small parts are immersed within a suitable electrolyte which contains heavy metal ions. This electrolyte is to constitute the plating metal. Under the influence of a low-voltage direct current, the metal ions are reduced to metal atoms which adhere to the small parts that are being coated.

Plating most commonly occurs in facilities that are designed just for plating. A typical plating facility utilizes a plurality of plating tanks which can range in size from holding a few gallons of electrolyte, which are used primarily for the electro-deposition of such costly metals as gold, rhodium and platinum, to thousands of gallons for the deposition of the common types of metal such as nickel and chromium. Barrel plating is used for the plating of small parts such as screws, washers, bolts and so forth. It is common that the small parts are placed in a rotating barrel which is perforated and immersed in the bath. One or more cathode terminals are to connect from the cathode into the barrel so that when the barrel is rotated, the small parts are constantly being in physical contact with the cathode terminal(s).

A common type of barrel plating apparatus comprises a frame on which is mounted the rotatable barrel. The barrel is to be rotated by a motor which is also mounted on the frame. The parts are to be placed in the barrel and the barrel closed with it being understood that the barrel is perforated so as to permit the electroplating solution to readily pass therethrough. The small parts plating apparatus is to be mounted within an electroplating tank. Normally, the small parts plating apparatus is mounted between the anode and cathode of the plating tank with the barrel being immersed in the electrolyte. In order to operate the motor, an appropriate source of electrical power is required. A typical source would be direct connection to a conventional source of electrical power that is transmitted to houses and buildings. It is most common that an electrical outlet is not conveniently available to each electroplating tank. Therefore, it is common to use extension cords that connect between the power source and the motor.

In a plant of any significant size, there may be ten to twenty electroplating tanks being used almost continually. It could very well be that five to ten of these tanks could be used to plate small parts and therefore a small parts plating apparatus is mounted in conjunction with each of these tanks. That means that there is a separate extension cord that is just laying across the floor of the facility connecting to each motor of each small part plating apparatus. These extension cords inherently present a hazard to human operators who are administering the electroplating process. The human operators frequently will trip over the extension cords, causing injury if the human operator falls. Additionally, electroplating solution is corrosive. This electroplating solution will invariably spill onto the floor and come in contact with the extension cords. Therefore, the corrosive solution can eat into the extension cords and cause their destruction. Besides the cords being destroyed, it also creates a fire hazard because bare electrical wires have been exposed.

SUMMARY OF THE INVENTION

The primary objective of the present invention is to construct a small parts plating apparatus which eliminates the need for an electrical extension cord connection from a power source in order to operate the motor that is mounted on the small parts plating apparatus.

The small parts plating apparatus of this invention utilizes a frame which is conventional. This frame is portable and can be readily manually lifted and deposited within an electroplating tank. Also this frame can be readily removed from the tank. The frame is to be supported by the structure of the tank with it commonly being supported between the anode and the cathode mounted within the tank. Mounted on the frame is a barrel with this barrel being rotatable. Rotation of the barrel is accomplished through a series of gears by means of an electrically operated motor. The motor is also mounted on the frame. A cathode terminal assembly is to connect from the cathode of the electroplating tank and be mounted within the barrel. Rotating of the barrel will result in the small parts physically contacting the cathode terminal assembly. Operation of the motor is to be achieved by applying power to the motor from the electroplating circuit of the anode and the cathode. The gear assembly can be disengaged while the motor is operating to permit visual inspection of the parts located within the barrel and then the motor reengaged. A battery is also mounted on the small parts plating apparatus which can be used to operate the motor when the small parts plating apparatus is mounted in a tank which does not include an electroplating circuit.

DETAILED DESCRIPTION OF THE PREFERRED EMBODIMENT

Figure 1:
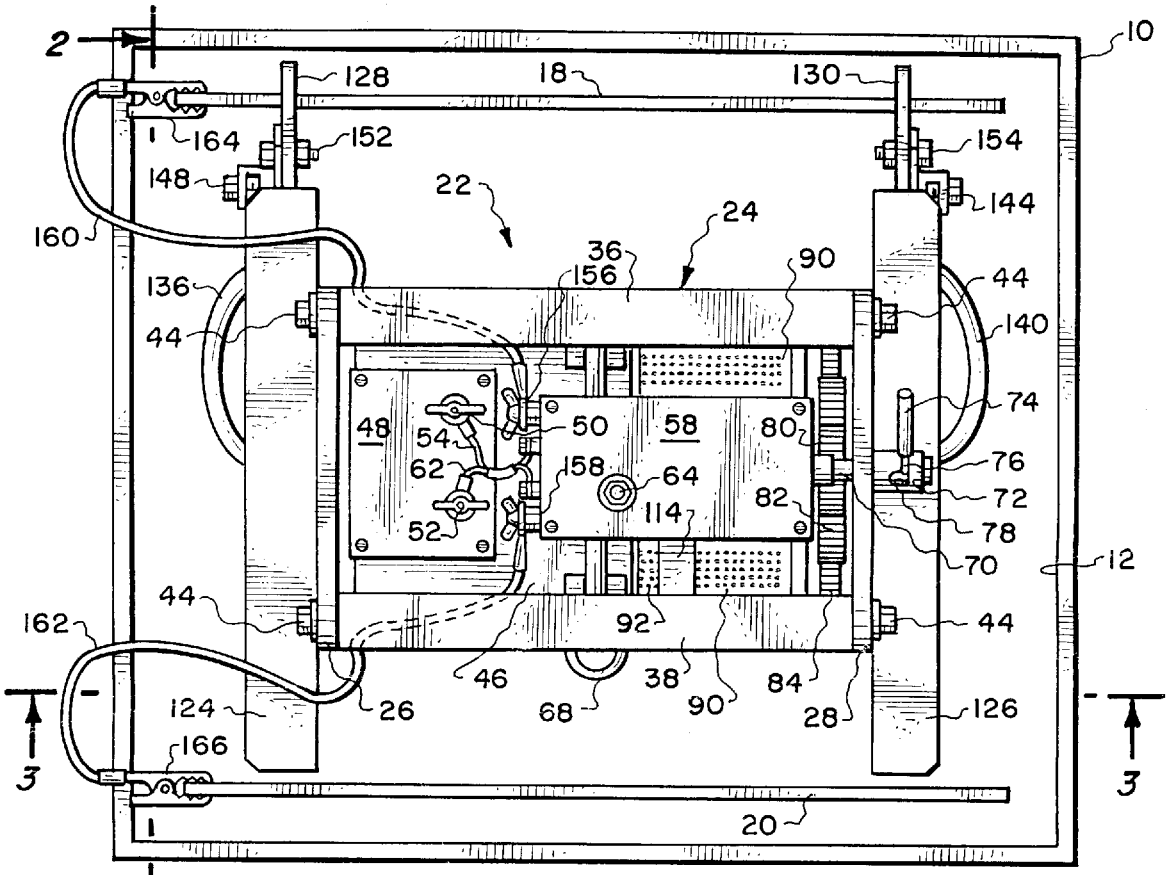
FIG. 1 is a top plan view of a typical electroplating tank within which has been mounted the small parts plating apparatus of the present invention.
Figure 2:
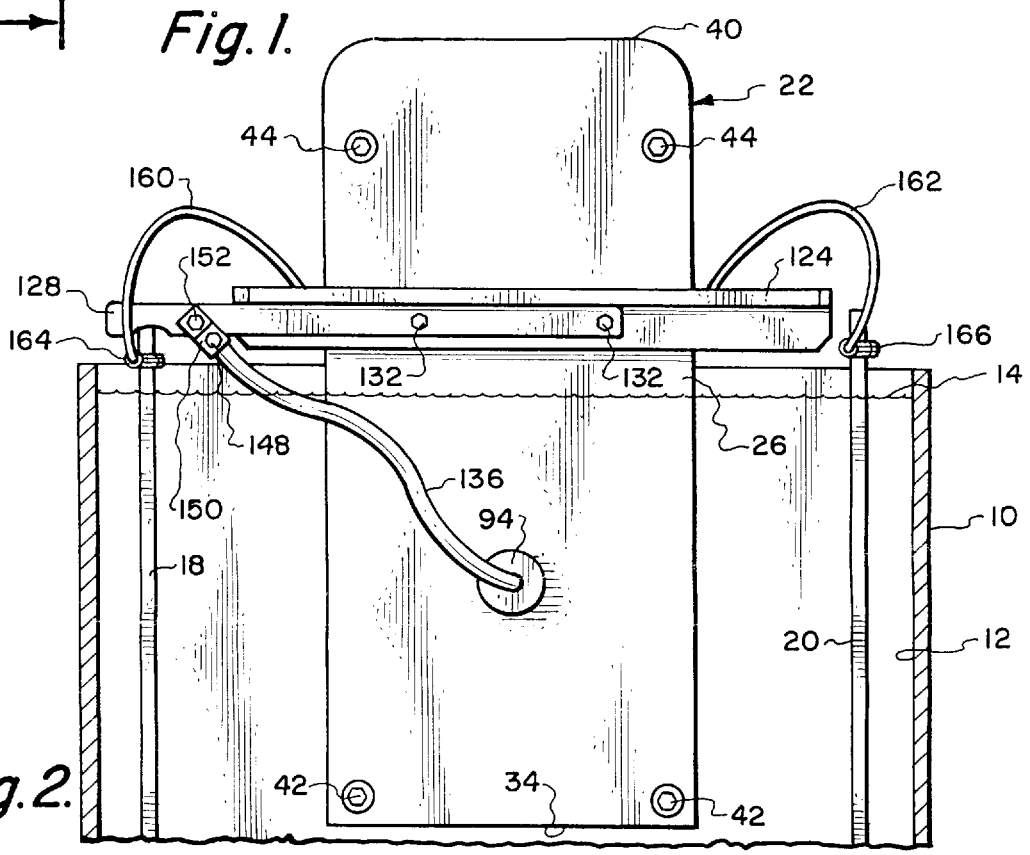
FIG. 2 is a left side view of the small parts plating apparatus of the present invention, partly in cross-section, taken along line 2—2 of FIG. 1.

Referring particularly to the drawings, there is depicted an electroplating tank 10 which has an internal chamber 12. It is to be understood that tank 10 will actually be a lot larger in size than what is shown in the drawings. The internal chamber 12 is to be substantially filled with an electrolyte solution 14. The electrolyte solution 14 is to contain the metal that is to be plated on the small parts 16.

Mounted within the internal chamber 12 is a cathode 18 and an anode 20. The cathode 18 is an electrical conductive plate which includes heavy metal ions of the plating metal. The anode 20 is also an electrical conductive plate. Both the cathode 18 and the anode 20 are fixedly mounted in a spaced apart relationship to the tank 10.

The small parts plating apparatus 22 of this invention is constructed primarily of a plastic frame 24. It is to be readily apparent that the frame 24 is not electrically conductive. The frame 24 is composed of spaced-apart sheet material planer sidewalls 26 and 28. The sidewalls 26 and 28 are secured together in a single unit by means of a pair of rods 30 and 32 which are located in a spaced-apart relationship at the bottom end 34 of the small parts plating apparatus 22 and also by means of channel members 36 and 38 which are located directly adjacent the upper end 40 of the small parts plating apparatus 22 of this invention. The rods 30 and 32 are mounted to the sidewalls 26 and 28 by bolt and nut fasteners 42. Similar bolt and nut fasteners 44 are used to mount channel members 36 and 38 to the sidewalls 26 and 28. Securely connected by bolts (not shown) to the sidewall 26 is a floor plate 46. Floor plate 46 is also attached to channel member 38 by bolt fasteners 37 and 39. The purpose of the floor plate 46 is to support a battery which is mounted within the battery housing 48. The battery within the battery housing 48 is connected electrically to positive terminal 50 and negative terminal 52 mounted on the battery housing 48. The positive terminal 50 is connected by a wire 54 through a positive terminal 56 of a motor 57 mounted in the motor housing 58. Also mounted on the motor housing 58 is a negative terminal 60. A wire 62 connects between the negative terminal 52 and the negative terminal 60. Also mounted on the motor housing 58 is a three-way switch 64. With the three-way switch 64 in its leftmost position, which is shown in phantom lines in FIG. 3, the battery located within the battery housing 48 supplies electrical power to operate the motor 57. With the switch 64 in the solid line position shown in FIG. 3, the motor 57 is deactivated.

One end of the motor housing 58 is supported by rod 66. Rod 66 passes through the motor housing 58 and is mounted within appropriate aligned holes of the channel members 36 and 38. The rod 66 includes a handle member 68 which permits manual removal of the rod 66 in order to achieve removal of the motor housing 58 for reasons of maintenance or replacement of motor 57. The opposite end of the motor housing 58 is secured to a support rod 70. The support rod 70 is conducted through a hole (not shown) formed within the sidewall 28. The support rod 70 then is mounted within a sleeve 72. Support rod 70 is non-circular, and when pivoted within the sleeve 72, physically raises and lowers the motor housing 58 a short distance, such as about one-quarter inch. This pivoting of the support rod 70 is to be accomplished manually by means of handle 74 which is mounted on rod 76 which in turn is conducted through bayonet slot 78 formed within the sleeve 72. This pivoting within the bayonet slot 78 is about ninety degrees and the reason for this pivoting will become apparent further on in the specification.

The output shaft of the motor within the motor 57 causes rotation of a drive gear 80. The drive gear 80 is operatively connected to an idler gear 82 with the idler gear 82 being rotatably mounted on the sidewall 28. The idler gear 82 meshes with a driven gear 84. The driven gear 84 is integral with a stub shaft 86. The stub shaft 86 is rotatably mounted within a hole 88 formed within the sidewall 28. The driven gear 84 is fixedly mounted to the barrel 90 by fasteners 83.

Also integral with the stub shaft 86 and with the driven gear 84 is a barrel 90. The barrel 90 includes a mass of perforations 92. The outer end of the barrel 90 is integrally connected to a stub shaft 94. The stub shaft 94 is rotatably mounted within hole 96 formed within sidewall 26.

Mounted on the rod 66 is a pair of spacing sleeves 98 and 100. The spacing sleeve 98 is to be located on one side of the motor housing 58 with the spacing sleeve 100 located on the opposite side of the motor housing 58. It is the function of the spacing sleeves 98 and 100 to position the motor housing 58 equidistantly between channel members 36 and 38.

The barrel 90 has an internal compartment 102 within which is to be located the small parts 16. Access into the internal compartment 102 is obtained through door 104. Door 104 fits within enlarged opening 106 formed within the barrel 90. The door 104 also includes a series of perforations 108. The door 104 also includes a handle 110 which facilitates manual grasping and removal of the door 104 from the enlarged opening 106 and replacement of such. To securely hold the door 104 in position within enlarged opening 106, there is utilized spring clamp members 112 and 114. Spring clamp members 112 and 114 are to engage with raised areas 116 and 118 formed on the barrel 90. When so engaged with the raised areas 116 and 118, the spring clamp members 112 and 114 press down against the handle 110 holding the door 104 in its installed position. Spring clamp members 112 and 114 can be manually disengaged from the barrel 90 by lifting of handle 120 of spring clamp member 112 and handle 122 of spring clamp member 114. Reinstallation of the spring clamp members 112 and 114 is accomplished by merely pressing on the spring clamp members 112 and 114 with sufficient force that they will be mounted between the raised areas 116 and 118.

Mounted on the exterior surface of the sidewall 26 is an L-shaped bar 124. A similar L-shaped bar 126 is mounted on the exterior surface of the sidewall 28. The L-shaped bars 124 and 126 are located parallel to each other and are positioned at the same height on the sidewalls 26 and 28. The L-shaped bars 124 and 126 will also be constructed of a non-electrically conductive material which in most cases would be plastic. The outer end of the L-shaped bars 124 and 126 is designed to rest on the anode plate 120. This will support the front end of the small parts plating apparatus 22. Supporting of the rear end of the small parts plating apparatus 22 is accomplished by means of strip conductors 128 and 130 which are resting on the cathode 18. Strip conductors 128 and 130 are electrically conductive with generally a copper material being preferred. Strip conductor 128 is mounted by fasteners 132 to the L-shaped bar 124. In a similar manner, strip conductor 130 is mounted by fasteners 134 to the L-shaped bar 126. Electrically connecting with the. strip conductor 128 is a wire 136. Wire 136 terminates in a bare terminal 138. Bare terminal 138 is located within the internal compartment 102 of the barrel 90 with the wire 136 passing through the center of the stub shaft 94. The barrel 90 rotates about the wire 136. The bare terminal 138 can be pushed further within the internal compartment 102 and located in any desired position, but it is not possible to withdraw the bare terminal 138 from the internal compartment 102. Mounted in a similar manner is a bare terminal 142 which is attached to a wire 140. Barrel also rotates about wire 140. The bare terminal 142 is located at the opposite end of the internal chamber 102 of the barrel 90 with the bare terminal 142 in alignment with the bare terminal 138. Again, the bare terminal 142 can be moved several inches within the confines of the internal chamber 102 if such is deemed to be desirable. The wire 140 is mounted by means of fastener 144 to a bracket 146. The bracket 146 is mounted by fastener 154 to the strip conductor 130. The wire 136 is mounted by fastener 148 to a bracket 150. The bracket 150 is mounted by the fastener 152 to the strip conductor 128.

The motor 57 is connected to terminals 156 and 158 mounted on the motor housing 58. Terminal 156 is connected to electrical connecting wire 160 with terminal 158 connected to electrical connecting wire 162. Wire 160 connects with alligator clamp 164. Wire 162 connects with alligator clamp 166. Alligator clamp 164 is to be mounted on the cathode 18 with the alligator it clamp 166 being mounted on the anode 20. With the switch 64 mounted in the right hand position shown in phantom lines in FIG. 3, the electrical power derived from the motor within the motor housing 58 is obtained from the cathode 18 and the anode 20. The motor 57 is a conventional off-the-shelf motor with the windings of the motor being modified (decreased in length thereby decreasing resistance) so that the motor 57 will operate anywhere from four to fifteen volts. Depending upon what type of plating is occurring and the size of the parts that are being plated, the voltage will normally vary between four and twelve volts during the plating operation. Silver plating small parts may only require four volts. Nickel plating of intricate parts requires a higher voltage such as twelve volts.

The operation of the small parts plating apparatus 22 of this invention is as follows: Small parts 16 are placed within the internal compartment 102, door 104 placed within the enlarged opening 106 and spring clamp members 112 and 114 are installed in position on the barrel 90. The barrel 90 is then immersed within the electrolyte solution 14 with the strip conductors 128 and 130 being mounted on the cathode 18 and L-shaped bars 124 and 126 being mounted on the anode 20. The operator then installs alligator clamp 164 in conjunction with the cathode 18 and alligator clamp 166 in conjunction with the anode 20. The operator then pushes the switch 64 to the right hand dotted position shown in FIG. 3 which will then supply electrical power to the motor contained with the motor housing 58 from the electroplating circuit between anode 20 and cathode 18. The motor 57 will rotate the drive gear 80, idler gear 82 and the driven gear 84 which in turn will cause rotation of the barrel 90. As the barrel 90 is rotated, the small parts 16 contained therein are tumbled with some of the small parts 16 coming into contact with the bare terminals 138 and 142. This means that an electrical circuit is established with those parts and also any parts that are in contact with those parts. The result is, as the tumbling continues, adequate plating will occur of the small parts 16 of the metal dissolved within the electrolyte solution 14.

Let it be assumed that the operator decides than an adequate amount of time has passed for plating to occur of the small parts 16. The operator can pivot handle 74 form the position shown in FIG. 1 to the opposite end of the bayonet slot 78. This will cause the drive gear 80 to become disengaged from the idler gear 82 which will cause the barrel 90 to stop rotation with the motor still operating. The operator can then remove the spring clamp members 112 and 114 and the door 104 and then examine the small parts 16 to determine if adequate plating has occurred. If adequate plating has not occurred, the operator only needs to reinstall the door 104 and the spring clamp members 112 and 114 and then move the handle 74 to the opposite end of the bayonet slot 78 which will then cause the drive gear 80 to reengage with the idler gear 82 and the barrel 90 will again be rotated.

Figure 3:
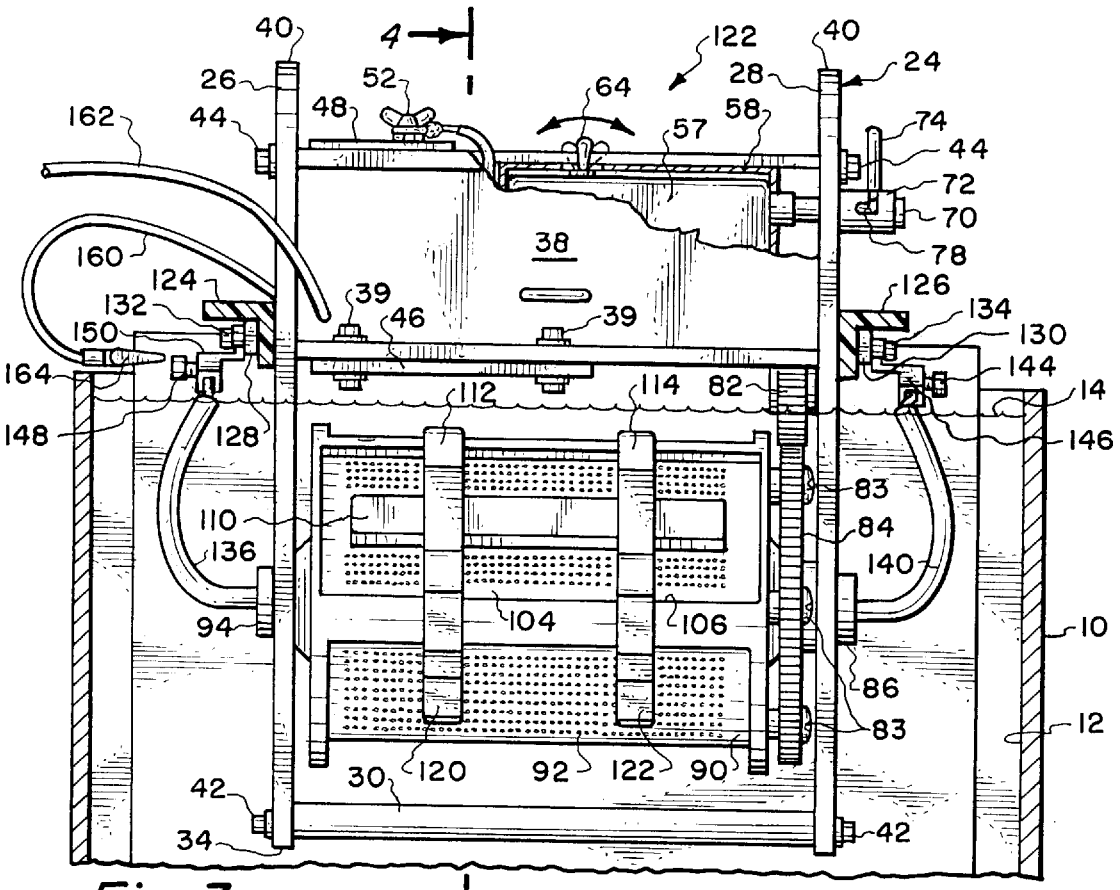
FIG. 3 is a front view of the small parts plating apparatus of the present invention, partly in cross-section, taken along line 3—3 of FIG. 1.
Figure 5:
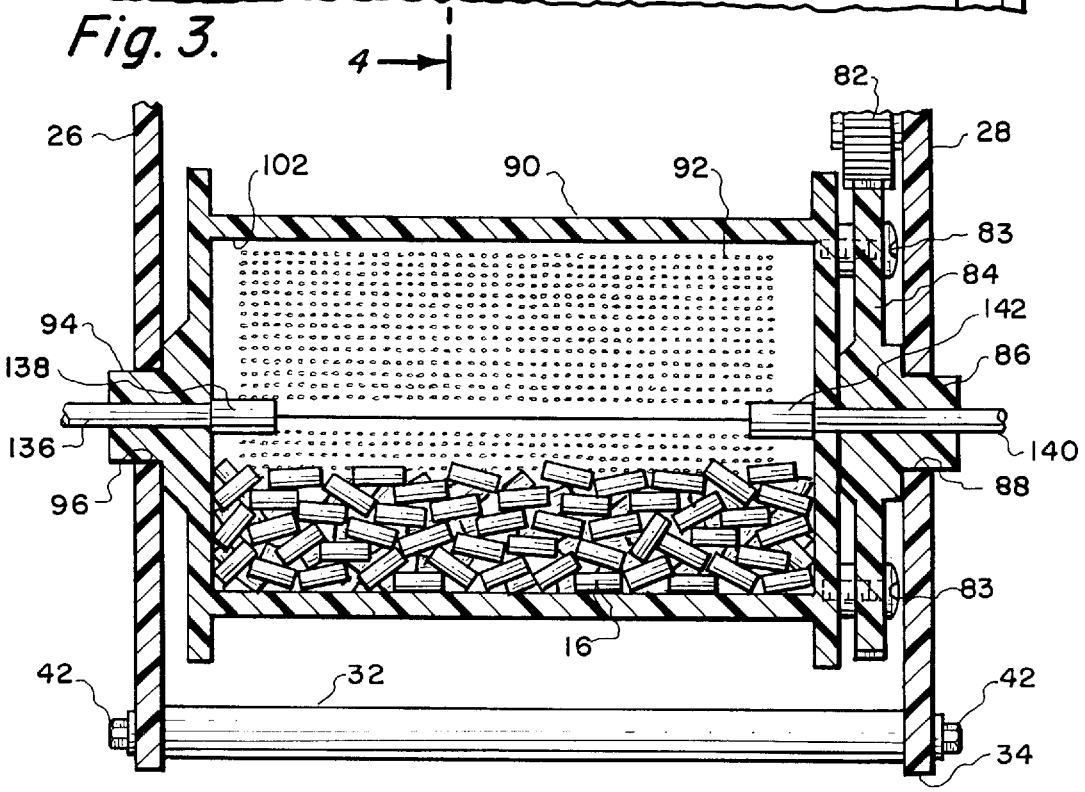
FIG. 5 is a cross-sectional view through the barrel utilized in conjunction with the small parts plating apparatus of the present invention taken along line 5—5 of FIG. 4.
Figure 4:
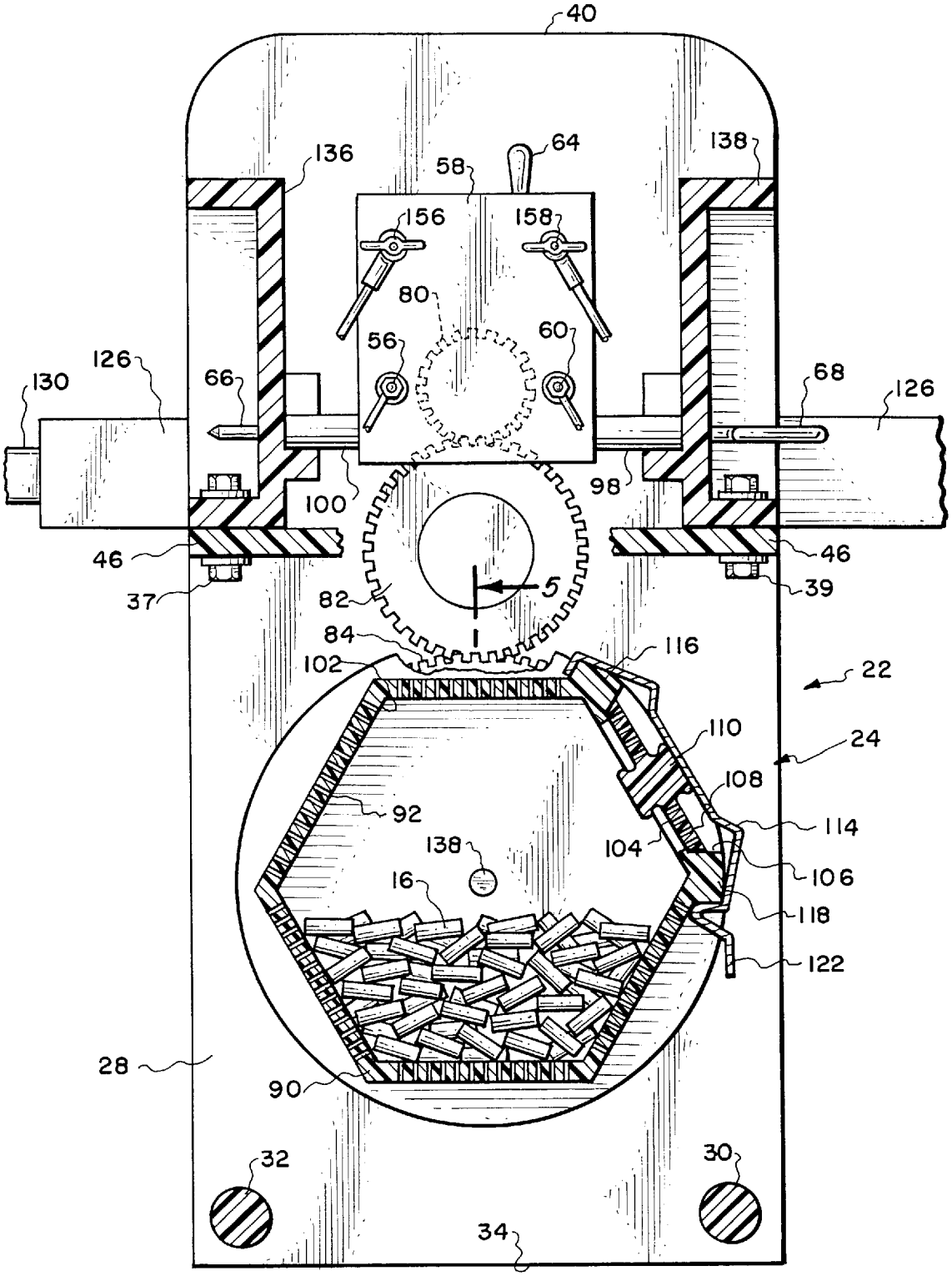
FIG. 4 is a cross-sectional view of the small parts plating apparatus of the present invention taken along line 4—4 of FIG. 3.

When the small parts 16 have been adequately plated, the operator moves switch 64 to the solid line position shown in FIG. 3 which will deactivate the motor 57. The operator then disengages the alligator clamps 164 and 166 and lifts the frame of the small parts plating apparatus 22 by lifting of the L-shaped bars 124 and 126 and removal of the barrel 90 from the electrolyte solution 14. The barrel 90 can then be placed within a separate tank (not shown), such as a rinsing tank that contains a rinsing solution. The rinsing tank does not have an anode and a cathode and thereby has no electricity. The operator then moves the switch 64 to the leftmost dotted line position shown in FIG. 3. This will cause the motor 57 to be operated electrically by means of the battery contained within the battery housing 48. Typically, the battery will rotate the barrel 90 for a period of three to four hours before it requires recharging. A single rinsing procedure only takes a few minutes. Therefore, the battery can be used for several rinses before recharging will be necessary.

After the parts 16 are adequately rinsed, the switch 64 is then moved to the deactivated position which will stop the rotation of the barrel 90. The small parts plating apparatus 22 is then removed by grasping of the L-shaped bars 124 and 126. The parts 16 are then removed from the internal compartment 102.

What is claimed is:

1. In combination with an electroplating tank having an anode spaced from a cathode, both said anode and said cathode adapted for immersion in an electroplating bath located in said tank, a small parts plating apparatus mounted within said tank, said small parts plating apparatus being removable from said tank, said small parts plating apparatus having a barrel which is adapted to contain a quantity of small parts to be plated, said barrel being rotatable by an electric motor, said electric motor having a positive connecting terminal and a negative connecting terminal, connecting said positive connecting terminal and said negative connecting to an electrical power source will result in operation of said motor, the improvement comprising:

a positive wire connecting to said positive electric terminal, a negative wire connecting to said negative electric terminal, connecting of said positive wire to said anode and connecting of said negative wire to said cathode results in operation of said motor and rotating of said barrel.

2. The combination as defined in claim 1 wherein:

a battery being mounted on said small parts plating apparatus, said battery being connected to said motor, upon locating of said small parts plating apparatus in conjunction with a tank that does not have an anode and a cathode said battery can be connected to operate said motor to cause rotation of said barrel.

3. The combination as defined in claim 1 wherein:

at least one cathode terminal connected to said cathode, said cathode terminal being located within the interior of said barrel.

4. The combination as defined in claim 1 wherein:

said motor operating through a gear drive assembly to cause rotation of said barrel, means for disengaging said gear drive assembly during operation of said motor that permits temporary access into the small parts contained within said barrel to ascertain the extent of plating occurring on the small parts.

5. A small parts plating apparatus comprising:

a frame adapted to be mounted on an electroplating tank adapted to include an electroplating bath, said electroplating tank having and an anode and a cathode;

a motor mounted on said frame, said motor having a positive connecting terminal and a negative connecting terminal;

a barrel mounted on said frame, said motor being connected through drive means to rotate said barrel, said barrel adapted to contain a plurality of small parts to be plated, said barrel adapted for immersion in an electroplating bath; and a first wire connecting with said positive connecting terminal, a second wire connecting with said negative connecting terminal, said first wire adapted to connect with the anode, said second wire adapted to connect with the cathode, power to run said motor is obtained from the electrical circuit which is used to cause the electroplating of the small parts.

6. The small parts plating apparatus as defined in claim 5 wherein:

said drive means comprising a series of gears.

7. The small parts plating apparatus as defined in claim 5 wherein:

said drive means being disengageable to stop the rotation of said barrel even while said motor is being operated.

8. The small parts plating apparatus as defined in claim 5 wherein:

at least one cathode terminal being mounted within said barrel, said cathode terminal adapted to connect to said cathode.

9. The small parts plating apparatus as defined in claim 5 wherein:

a battery being mounted on said frame, said battery being connected to said motor, said battery to be usable to operate said motor to cause rotation of said barrel when said small parts plating apparatus is not mounted on a tank that includes an anode and a cathode.

* * * * *